US006267506B1

(12) United States Patent
Campion

(10) Patent No.: US 6,267,506 B1
(45) Date of Patent: Jul. 31, 2001

(54) FOLD-TOP CLOSURE AND METHOD THEREFOR

(76) Inventor: Chris Campion, G/F 110 Man Nin Street, Sai Kung, Kowloon (HK)

( * ) Notice: Subject to any disclaimer, the term of this patent is extended or adjusted under 35 U.S.C. 154(b) by 0 days.

(21) Appl. No.: 09/513,322

(22) Filed: Feb. 25, 2000

Related U.S. Application Data

(60) Provisional application No. 60/122,150, filed on Feb. 26, 1999.

(51) Int. Cl.[7] ..... B65D 33/16; A45F 3/16

(52) U.S. Cl. ..... 383/59; 224/148.2; 383/35; 383/61; 383/906; 383/83; 383/89

(58) Field of Search ..... 383/35, 33, 61, 383/59, 83, 88, 89, 85, 901, 906; 224/148.2, 235

(56) References Cited

U.S. PATENT DOCUMENTS

| | | | | |
|---|---|---|---|---|
| 488,783 | * | 12/1892 | Weber | 383/35 |
| 1,236,159 | * | 8/1917 | Gatlin . | |
| 1,782,240 | * | 11/1930 | Litchfield | 383/89 |
| 1,919,819 | * | 7/1933 | Williams . | |
| 2,138,066 | * | 11/1938 | Matchett . | |
| 2,246,596 | * | 6/1941 | Moore . | |
| 2,342,406 | | 2/1944 | Latta . | |
| 2,345,434 | * | 3/1944 | Sterling | 383/92 X |
| 2,688,435 | * | 9/1954 | Vogt . | |
| 3,203,551 | | 8/1965 | Van Loan . | |
| 3,212,698 | | 10/1965 | Balcom . | |
| 3,254,829 | * | 6/1966 | Cooper . | |
| 3,446,420 | | 5/1969 | Rinecker . | |
| 3,545,668 | * | 12/1970 | Hultberg . | |
| 4,356,954 | * | 11/1982 | Mojonnier . | |
| 4,876,125 | * | 10/1989 | Akao et al. | 383/88 X |
| 4,911,563 | | 3/1990 | Ciani . | |
| 5,582,889 | | 12/1996 | Pedrini . | |
| 5,816,709 | | 10/1998 | Demus . | |
| 5,824,380 | * | 10/1998 | Hagen . | |
| 5,885,434 | | 6/1999 | Hagen . | |
| 5,941,640 | | 8/1999 | Thatcher . | |

* cited by examiner

*Primary Examiner*—Allan N. Shoap
*Assistant Examiner*—Robin A. Hylton
(74) *Attorney, Agent, or Firm*—Brian Beverly

(57) ABSTRACT

A leak-proof fold-top closure and bag comprise front and back sheets of flexible material joined together at lateral sides, but open on top, and a semi-rigid splint attached to the back sheet, wherein a closed configuration includes a first fold formed by folding an upper section of the sheets over the splint and a second fold formed by folding the splint and both sheets forward again to define a reverse fold of the upper section trapped between the splint and bag material, the splint and folded sheets held in place by securing means.

26 Claims, 5 Drawing Sheets

FOLD-TOP CLOSURE AND METHOD THEREFOR

This application claims the benefit of U.S. Provisional Application No. 60/122,150, filed Feb. 26, 1999. The small entity statement filed by applicant in Application No. 60/122,150 is hereby referred to and relied upon by applicant pursuant to 37 C.F.R. 1.28.

BACKGROUND OF THE INVENTION

1. Field of the Invention

The invention relates to an improved closure for bags and like flexible containers which seals the bag fluid-tight and gas-tight yet allows easy and rapid reopening of the bag for access to its contents, and to a method directed to such an improved closure. The invention also relates to a fluid-tight and gas-tight bag having an improved leak-proof closure which allows easy and rapid reopening of the bag.

2. Prior Art

It is frequently desirable to have a light, resealable bag that is fluid-tight or gas-tight, either to keep the contents of the bag dry or to prevent liquids or gases from leaking out of the bag. The requirements in a bag for a leak-proof closure, yet one providing easy access to the bag and overall light weight, have a higher premium in more rigorous applications, e.g., cycling or back country hiking. Traditional methods of closure include so-called zip-lock or pressure strips, clamps, clips, and threaded caps. Zip-lock strips have limited durability and often do not form a true gas-tight seal. Expensive molding equipment or tooling may be needed to form these closures. Such a closure may add an awkward element to the bag and access to the contents of the bag may be restricted if the nature of the closure, such as a cap, is narrower or more rigid than the main body of the bag.

Light weight, resealable bags are used increasingly in sporting activities. Limited access to the interior of prior art bags makes cleaning more difficult creating the potential for unsanitary or at least offensive conditions. Once liquid products placed in such sporting bags are consumed, the remaining deposits if not immediately and thoroughly cleaned encourage the growth of bacteria and mold. If left uncleaned, such growths can leave ugly stains on the bag, may tenaciously retain offensive odors, taint any other fluids subsequently introduced into the bag, and can create serious health risks. Regular and thorough cleaning is therefore critical, especially if it is desired to use dairy-based products in the bag. Prior art bags which are truly fluid- or gas-tight do not provide adequate access to their interiors for cleaning.

Many flexible bags have been developed which can be sealed and resealed to close the bag's contents from environmental contaminants. In particular, several closures have been developed which improve the seal by rolling or folding that portion of the bag near the opening back upon itself For example, Dernmis, U.S. Pat. No. 5,816,709, discloses a leak-proof travel bag for carrying items containing liquids, such as toiletry products, while traveling. The Denius bag shows a zip-lock closure for sealing and resealing the opening of a water-proof bag. The bag is closed by sealing the opening with the zip-lock closure, folding the closure strip over once, then again, whereupon it is sealed to the bag using a hook-and-loop-type fastener, and finally sealing the folded-over portion with a flap using a second hook-and-loop-type fastener.

Rinecker, U.S. Pat. No. 3,446,420 discloses a flexible mouth container wherein the mouth of a container having a sheet-like opening is folded over upon itself and secured with a hook-and-loop-type fastener. Similarly, Vani Loan, U.S. Pat. No. 3,203,551 discloses a filter bag including a cover flap to close the bag. The cover flap is folded over and held in place against the bag with a hook-and-loop-type fastener or a plastic zipper and locking tabs. Finally, Latia, U.S. Pat. No. 2,342,406 discloses a fumigant bag which is closed by joining two stiff, but bendable, strips at the mouth of the bag and folding them down together several times where they are secured in place with ties.

While the roll-down style closures have certain advantages over prior art closures, they tend not to form perfect seals and, especially when the contents of the bag are under pressure, the rolled part of the bag may unroll or loosen thereby decreasing the effectiveness of the seal. There is accordingly a need for an improved bag closure which creates a fluid-tight or gas-tight seal yet which is simple to operate, provides easy and rapid opening for access to the contents of the bag, is light weight, and is inexpensive to manufacture.

SUMMARY OF THE INVENTION

The invention comprises a flexible bag made of two sheets of leak-proof material permanently joined on three sides thus forming an opening at the one remaining side. A semi-rigid splint is fixed to one of the sheets below the opening at a distance of at least twice the width of the splint and there extends from side to side across the entire width of the opening. The splint is flexible, but at rest holds the sheets straight and in parallel alignment. The bag is easily opened by bending the splint and separating the two sheets. A flap of fastening material is joined to the front of the bag at a line approximately twice the width of the splint below the lower edge of the splint. A cooperating panel of fastening material is attached to the back of the bag beginning just below the lower edge of the splint. Closure is performed by first folding an upper section of the two sheets disposed above the upper edge of the splint forward over the splint at a fold line coincident with the upper edge of the splint. A second fold is made by folding the upper section forward over at a fold line coincident with the lower edge of the splint. The second fold turns the first section back upon itself in a tight reverse fold trapped between the splint and the bag material beneath and just below the splint. The splint is then folded forward over again which brings the cooperating panel on the back of the bag adjacent to the fastening flap on the front of the bag. The fastening flap is then fastened to the cooperating panel to hold the folds of the bag material tightly around the splint. In particular, the reverse fold is held snugly in place by the fastening flap. The splint prevents the folded material from unrolling because of the resistance provided by its width.

The seal created by the above closure gets tighter as the pressure of the contents of the bag is increased. The folding pattern of the invention places the folded section between the opening and the splint inside the folds of bag material from below the splint. If pressure from contents of the bag is introduced into the latter folds they will force the two sheets there apart and hence expand against the inner folded section, including the reverse fold, increasingly tightening the inner folds in direct proportion to the expansive pressure from the surrounding folds and thus tightening the seal formed by the inner folds. Accordingly, the closure is particularly effective where the contents of the bag are under pressure, as for example, if a gaseous material were introduced to the bag after it had been closed.

In one embodiment of the invention, the bag is provided with a tube having a valve. After the bag is closed, contents may be introduced into the bag through the tube. For instance, water may be placed in the bag after it is closed and then drawn out as needed through the tube. After all the water is consumed, the bag can be opened for cleaning and reuse. It is desirable to use material for construction of the bag which is not only leak-proof, but appropriately puncture resistant depending upon the ruggedness of the anticipated use.

DETAILED DESCRIPTION OF THE INVENTION

Figure 1:
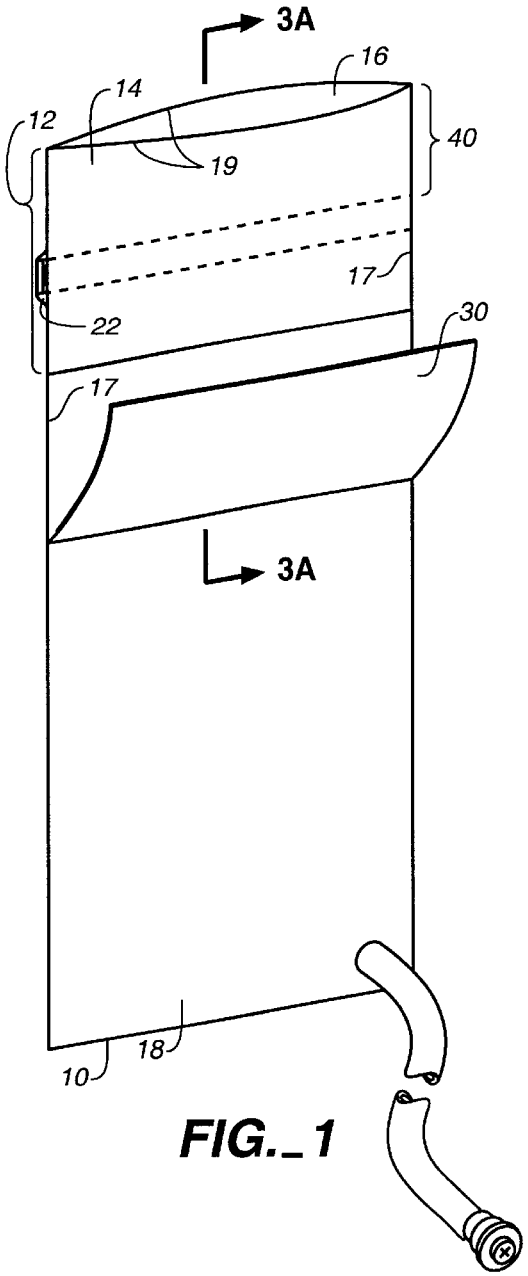
FIG. 1 is a perspective view of a bag having a leak-proof bag closure according to the invention showing the closure in its open configuration.
Figure 2:
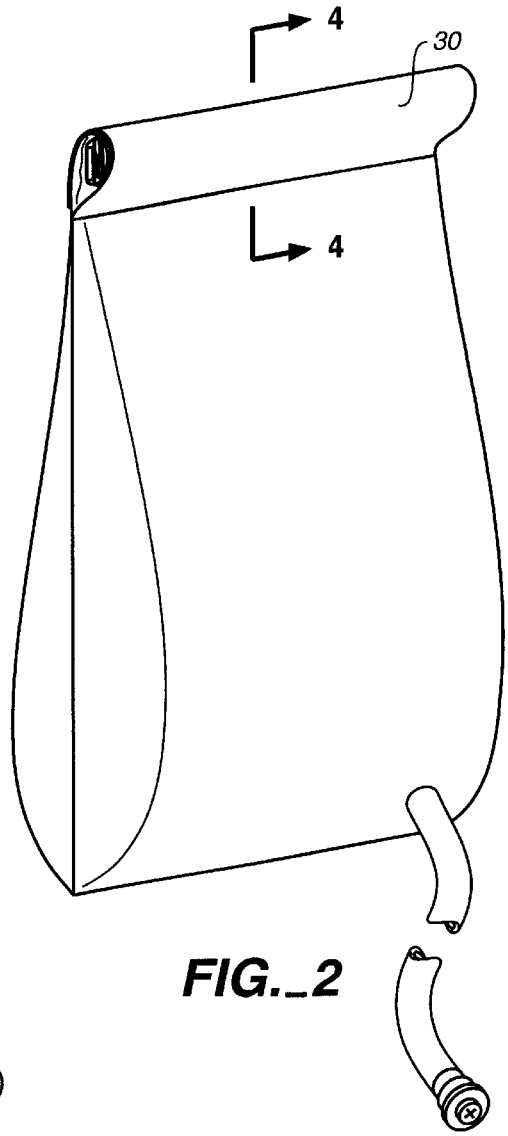
FIG. 2 is a perspective view of the bag and leak-proof closure of FIG. 1 showing the closure in its closed configuration.

A bag 10 having a leak-proof closure 12 according to the invention is shown generally in FIG. 1. The bag comprises a front sheet 14 and back sheet 16 of flexible material. Preferably, the sheets are manufactured of flexible polyurethane, but could also be constructed of any flexible membrane impervious to fluids or gases. In the preferred embodiment, the sheets 14 and 16 have lateral sides 17, a bottom portion 18 and top edges 19, and the sheets are joined at the sides and bottom portion, leaving an opening at the top edges 19 of the sheets. However, in alternate embodiments the two sheets could assume many other configurations, such as circular or elliptical, and could be joined on all sides except at designated area to form an opening. In a further embodiment, the sheets could be non-symmetrical such that the opening may be "off-center" when open and, when closed, the bag may appear symmetrical. In yet other embodiments, the bag may take on a box or other three-dimensional shape. In the case of a three-dimensional bag, a further embodiment of the opening may involve front, back and side sheets, instead of just a front sheet and back sheets, such that the front, back and side sheets fold into a closed position.

Figure 3A:
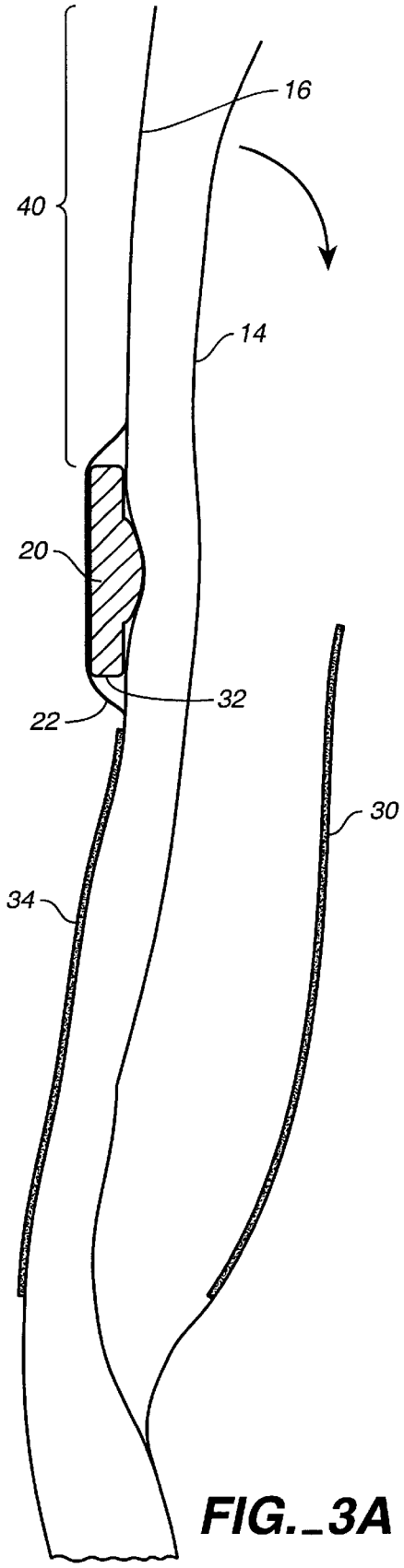
FIG. 3A is an enlarged sectional view of the closure in its open configuration shown in FIG. 1 taken along line 3A—3A.

In the preferred embodiment, the back sheet 16 of the bag is fitted with a flexible, semi-rigid splint 20 as seen in FIG. 3A. The splint 20 could be fitted to the front sheet 14 of the bag and also be effective, but fitting the splint 20 to the back sheet 16 traps the front sheet 14 of the bag during the folding process as will be discussed below.

Referring again to FIG. 1, the splint 20 is positioned across the width of the bag at a distance preferably at least twice the width of the splint below the top edges 19 of the front and back sheets 14 and 16. Preferably, the splint 20 is inserted in a sleeve 22 provided in the bag material thus allowing the splint 20 to be removed as a convenience when not needed. Alternatively, the splint 20 may be permanently fixed to the bag using adhesives, heat bonding or any of many joining methods well known in the art. The splint 20 is affixed along its length across the entire width of the bag and must therefore have sufficient flexibility to allow the bag material to bend so that the bag may be opened. Preferably, the splint 20 has a physical memory which urges it to return to a linear position after being flexed. In the preferred embodiment the splint is approximately 7/16th of an inch wide and approximately 1/8th of an inch thick; however, any semi-rigid, flexible material with a cross-sectional profile substantially wider than thick will function adequately. In its linear position, the splint 20 tends to hold the front and back sheets of the bag together in parallel alignment.

Figure 3B:
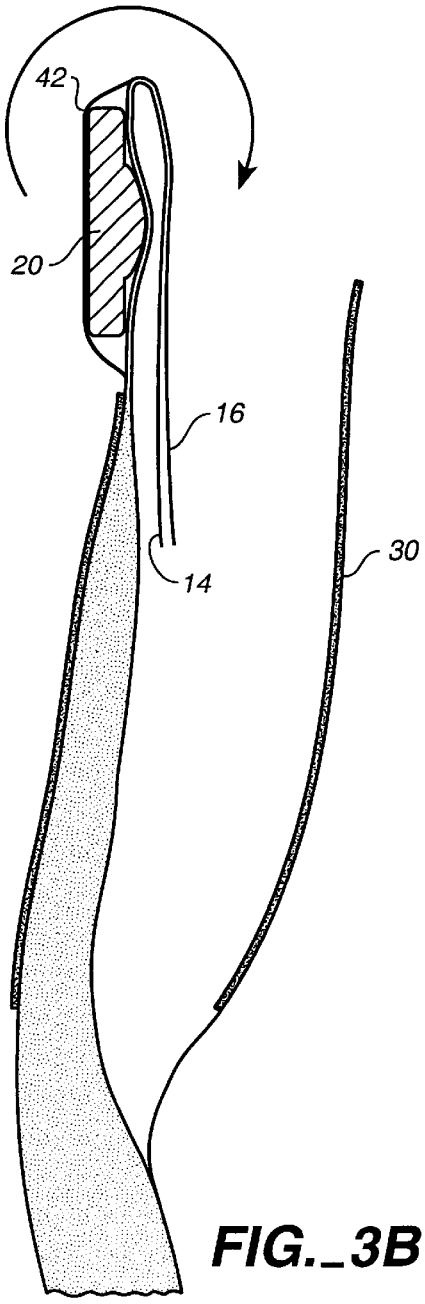
FIG. 3B is a sectional view of the closure similar to that shown in FIG. 3A showing the upper section of the bag folded forward adjacent the upper edge of the splint.
Figure 3C:
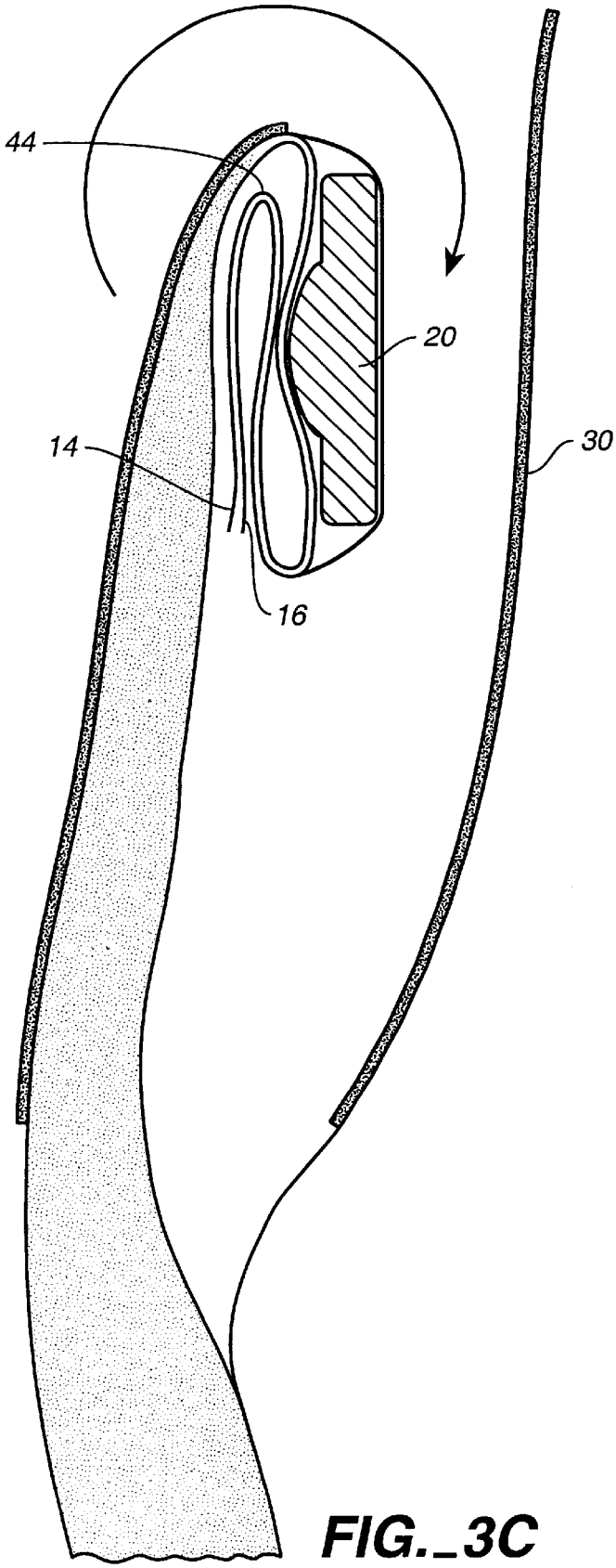
FIG. 3C is a sectional view of the closure similar to that shown in FIG. 3B showing the bag material folded forward a second time adjacent the lower edge of the splint.

As best seen in FIGS. 1 and 3A, a flap 30 of fastening material, is fastened to the front of the bag below the lower edge 32 of the splint 20 at a line approximately twice the width of the splint 20. A cooperating panel 34 of fastening material, shown in FIGS. 3A–3C, is affixed to the back sheet 16 of the bag just below the lower edge 32 of the splint 20. Preferably the fastening material is a hook-and-look-type fastener, but it could also be a releasable adhesive, a snap system, zipper, or any releasable fastening system known in the art.

Referring generally to FIGS. 3A–3D, the several steps involved in closing the bag 10 are demonstrated. First, as shown in FIG. 3B, the upper section 40 of bag material, disposed above the upper edge 42 of the splint 20, is folded forward over the splint 20. Next, as shown in FIG. 3C, the splint 20 is folded over in the same direction as the first fold, thereby folding and trapping the upper section 40 between the splint 20 and the bag material below and beneath the splint 20. This second fold creates a reverse fold at 44 in the upper section 40 which is folded in the opposite direction as the first two folds. The upper section 40 is thus folded back upon itself and the reverse fold 44 is tightly trapped between the splint 20 and the lower bag material.

It is preferable to mount the splint 20 approximately twice its width below the top opening in order to provide sufficient material to create the reverse fold 44. Alternatively, the splint 20 could be mounted slightly closer to the opening, but not so close that there would be insufficient material between the top edges 19 of the bag and the upper edge 42 of the splint 20 to form the reverse fold 44. In other embodiments, the splint 20 could be mounted somewhat farther from the opening.

Figure 3D:
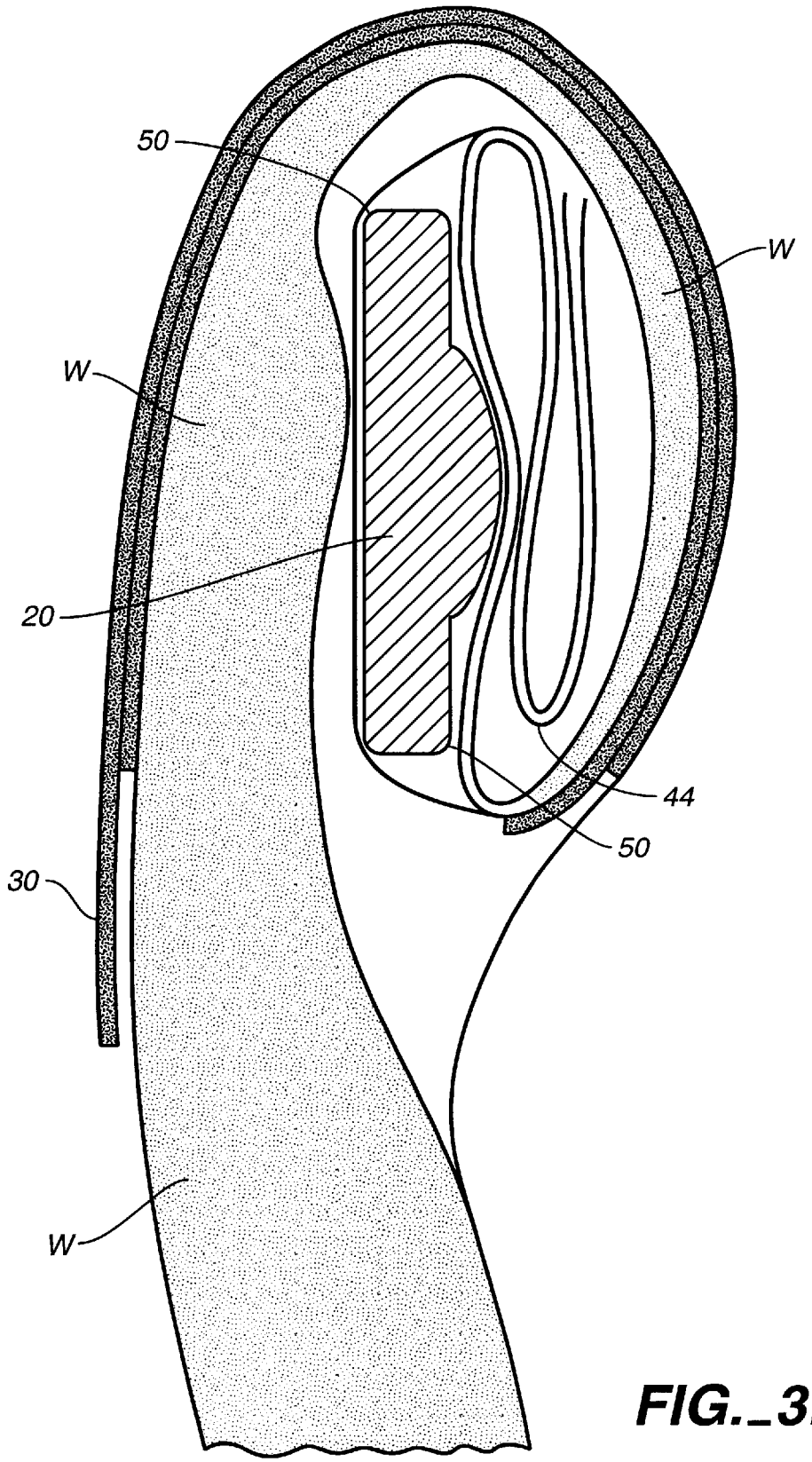
FIG. 3D is a sectional view of the closure similar to that shown in FIG. 3C showing the bag material folded forward a third time and the fastening flap folded over the top of the bag and joined to the cooperating panel on the back of the bag.

Finally, referring to FIG. 3D, the splint 20 is folded over forward in the direction of the arrow shown in FIG. 3D at least once again to bring the cooperating panel 34 adjacent the fastening flap 30. The fastening flap 30 is then wrapped over the cooperating panel 34 to capture the folded splint 20 and surrounding bag material. Preferably fastening flap 30 extends sufficiently from the front sheet 14 to wrap around the folded splint 20 and bag material, as seen in FIG. 3D. Preferably the cooperating panel 34 extends from the back sheet far enough up that it folds over during the last fold above described and as seen in FIG. 3D, such that the fastening flap 30 and cooperating panel 34 join together in an arc extending from the front of the bag in its closed configuration to the back for a firm closure. In alternative embodiments, the fastening flap 30 and cooperating panel 34 may have a smaller overlap and the overlap may be positioned anywhere such that the splint 20 and folded bag material are firmly help in their closed configuration. In another embodiment not illustrated, a securing strip is affixed to the front sheet 14 such that when the splint 20 and bag material are folded into the closed configuration, the cooperating panel 34 adheres to the securing strip.

FIG. 3D shows a cross-section of the bag closure 12 in closed position. The splint 20 and reverse fold 44 are surrounded by the folded bag material including upper section 40. The splint 20 prevents the folded bag material from unrolling because the splint 20 encounters resistance at corners 50 from the bag material trapped in place by fastener flap 30 and cooperating panel 34. The splint 20 effectively acts as a brake restraining the natural tendency of the bag material to unfold. The reverse fold at 44 therefore remains tightly trapped creating a fluid-tight and gas-tight seal. Absent the splint 20, the interior folds would have a greater tendency to unroll and leak. However, in alternate embodiments, reasonable levels of self-sealing may be achieved with the splint 20 removed. The illustrated embodiments provide a seal which not only prevents fluids or gases in the bag from leaking out, but also is effective to keep articles housed in the bag dry from surrounding ambient conditions by preventing fluids or gases surrounding the bag from entering its interior.

Figure 4:
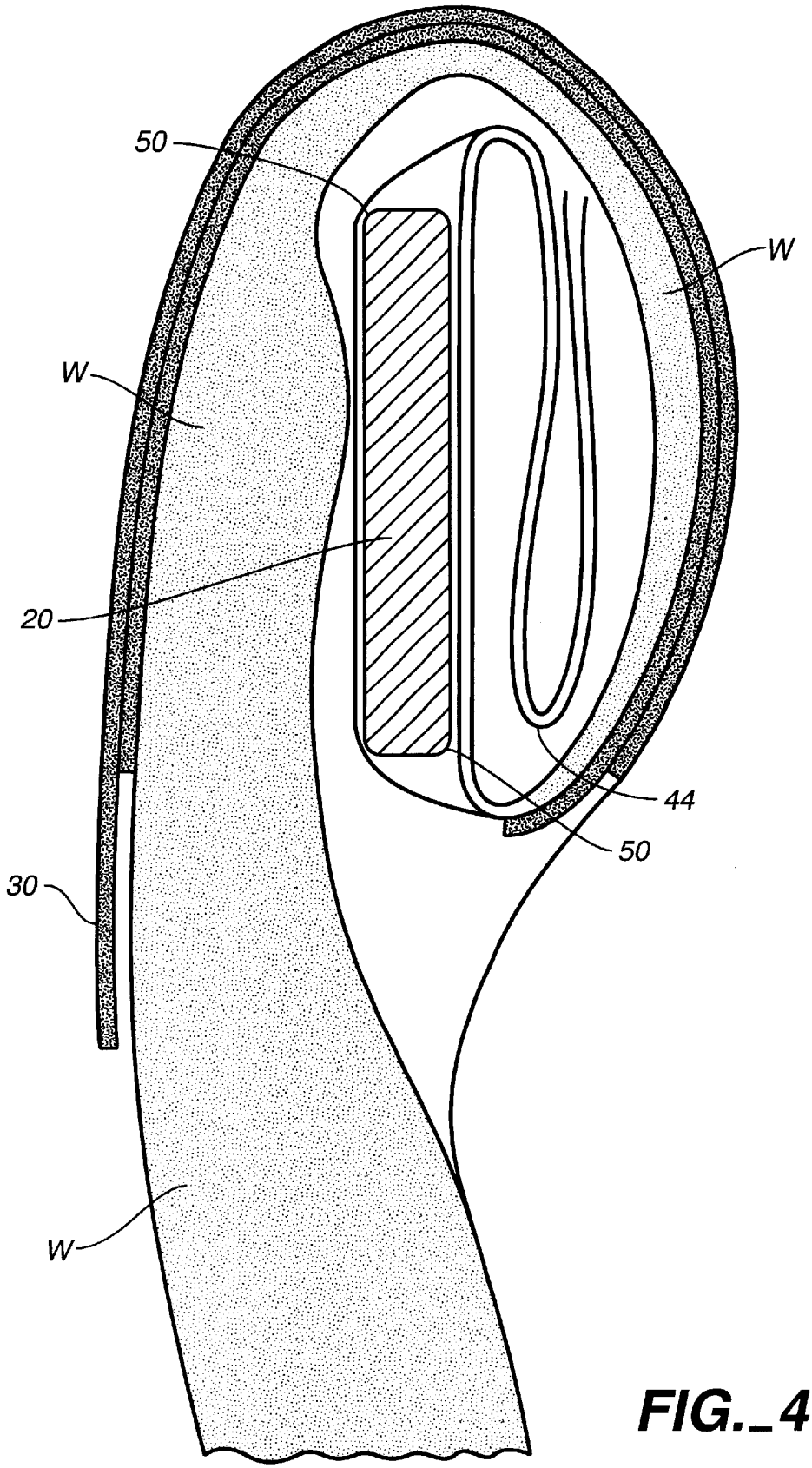
FIG. 4 is a sectional view of the closure similar to that shown in FIG. 3D including a splint without a central reinforcing rib.

The seal provided by the reverse fold 44 and the other interior folds of the bag material around the splint 20 provide an even tighter seal if the contents of the bag are placed under pressure. For example, the bag may be filled with water as indicated at areas W in FIG. 3D, then sealed using the closure, and placed in a back-pack or carrier for use while traveling. In that or similar settings an area of high pressure is created as seen in FIG. 4 in areas W. As a consequence areas W expand. Since the area surrounding the splint 20 is trapped by the fastener flap 30 and cooperating panel 34, areas W expand inwardly against the splint 20 and interior folds including reverse fold 44. The greater the expansion becomes, the tighter the interior folds are trapped, and the better becomes the seal provided thereby.

In a further embodiment of the invention, a tube having a valve is attached to the bag. Once the bag is sealed, liquid or gaseous contents may be introduced into the bag and placed under pressure. The tube is a sufficient length to extend from a back pack containing the bag to a mouthpiece from which the contents of the bag can be withdrawn as desired.

There have thus been described certain preferred embodiments of an improved leak-proof bag closure, a bag having such a closure, and a method for performing a leak-proof closure of a bag. While preferred embodiments have been described and disclosed, it will be recognized by those with skill in the art that modifications are within the true spirit and scope of the invention.

I claim:

1. A leak-proof closure comprising:

front and back sheets of flexible material each having sides, a top edge, and a bottom portion, said sheets joined together at said sides, said bottom portions for attachment to a container opening, said top edges not sealed but in planar apposition, a semi-rigid splint attached to said back sheet below said top edge extending approximately from one side to the other of said back sheet, said splint having upper and lower edges, an upper section of said sheets bounded by said top edge on top and by said upper edge of said splint on bottom, and a lower section of said sheets bounded by said upper edge of said splint on top and by said bottom portion on bottom, said sheets having an open configuration in which said top edges of said sheets are separated so that said sheets define a passage to a container opening, said sheets having a closed configuration defined by a first fold formed by folding said upper section of said sheets forward over said splint at a first fold line coincident with the upper edge of said splint thereby bringing said upper section into apposition with said splint, and a second fold formed by folding said upper and lower sections of said sheets forward at a second fold line coincident with said lower edge of said splint thereby folding said upper section back upon itself, and thereby further defining a reverse fold of said upper section converse to said first fold adjacent said lower edge of said splint, said reverse fold trapped between said splint and said lower section of said sheets, and securing means for securing said sheets and said splint in said closed configuration.

2. The closure of claim 1 wherein said front and back sheets of flexible material comprise polyurethane.

3. The closure of claim 1 including:

a flexible container having an opening, said bottom portion attached to said opening so that said sheets define a passage to said container opening.

4. The closure of claim 1 including:

a flexible container having an open upper portion, said bottom portions of said sheets of flexible material integral with said upper portion of said container forming a passage into said container.

5. The closure of claim 4 wherein:

said passage is large enough to admit a hand therethrough into said container.

6. The closure of claim 1 wherein:

said splint has a linear rest position and a physical memory which urges it to return to said rest position after being flexed.

7. The closure of claim 6 wherein:

said front and back sheets each have the same lateral dimension from one side to the other where said splint is attached to said back sheet, such that said splint in said rest position holds said front and back sheets in apposition adjacent said splint.

8. The closure of claim 1 wherein:

in cross-section, said splint has a thickness and an elongated width relative to said thickness.

9. The closure of claim 8 wherein:

said upper edge of said splint is spaced from said top edges of said sheets at least twice the width of said splint.

10. The closure of claim 1 wherein:

said securing means includes a fastening flap attached to said front sheet below said splint, said fastening flap having a securing panel, and said back sheet includes a cooperating panel, in said closed configuration said securing panel of said fastening flap demountably secured to said cooperating panel.

11. The closure of claim 10 wherein:

said securing panel of said fastening flap and said cooperating panel of said back sheet comprise a hook-and-loop-type fastener.

12. The closure of claim 1 wherein:

said securing means includes a securing strip attached to said front sheet, and a cooperating securing panel attached to said back sheet, in said closed configuration said securing strip demountably secured to said cooperating panel.

13. A leak-proof container comprising:

a flexible container having an upper portion, said upper portion having front and back sheets of flexible material, each said sheet having lateral sides and a top edge, said sheets joined together at said sides, said top edges in detached planar apposition, a semi-rigid splint attached to said back sheet below said top edge extending approximately from one side to the other of said back sheet, said splint having upper and lower edges, said splint further having a linear rest position and a physical memory which urges it to return to said linear rest position after being flexed, an upper section of said sheets bounded by said top edge on top and by said upper edge of said splint on bottom, and a lower section of said sheets having a top boundary at said upper edge of said splint, said sheets having an open configuration in which said splint is flexed and said sheets are separated defining an opening for said container, said opening large enough to admit a hand therethrough into said container, said sheets having a closed configuration defined by a first fold formed by folding said upper section of said sheets forward over said splint at a first fold line coincident with the upper edge of said splint thereby bringing said upper section into apposition with said splint, and a second fold formed by folding said upper and lower sections of said sheets forward at a second fold line coincident with said lower edge of said splint thereby folding said upper section back upon itself, thereby defining a reverse fold of said upper section converse to said first fold adjacent said lower edge of said splint, said reverse fold trapped between said splint and said lower section of said sheets, and a fastening flap attached to said front sheet below said splint, said fastening flap having a securing panel, said back sheet further including a cooperating panel, in said closed configuration said securing panel of said fastening flap demountably secured to said cooperating panel of said back sheet so that said front and back sheets and said splint are secured in said closed configuration.

14. The container of claim 13 wherein:

in cross-section, said splint has a thickness and an elongated width relative to said thickness.

15. The container of claim 14 wherein:

said upper edge of said splint spaced from said top edges of said sheets and at least twice the width of said splint.

16. The container of claim 13 wherein said front and back sheets of flexible material comprise polyurethane.

17. A method for leak-proof closing of a container, which comprises:

a. joining together sides of a front sheet of flexible material with sides of a back sheet of flexible material, the sheets having bottom portions for attachment to the container, so that a top edge of each sheet is adjacent but not sealed to the other top edge, b. attaching to the back sheet below the top edge thereof a semi-rigid splint extending approximately from one side of the back sheet to the other side, such that a passage to the container is provided by flexing the splint and separating the sheets, c. folding an upper section of the sheets, bounded by the top edge of the sheets on top and by an upper edge of the splint on bottom, over the splint at a first fold line coincident with the upper edge of the splint thereby forming a first fold and bringing the upper section of the sheets into apposition with the splint, d. folding the upper section of the sheets and a lower section of the sheets forward at a second fold line coincident with a lower edge of the splint, the lower section of the sheets bounded on top by the upper edge of the splint, thereby forming a reverse fold of the upper section of the sheets adjacent the lower edge of the splint and converse to the first fold and trapping the reverse fold between the splint and the lower section of the sheets, and e. securing the sheets and the splint in their folded configuration.

18. The closing method of claim 17 wherein:

the sheets each comprise polyurethane.

19. The closing method of claim 17 wherein:

the sides of the sheets are joined far enough apart such that the passage provided to the container is large enough to admit a hand therethrough into the container.

20. The closing method of claim 17 wherein:

in cross-section, the splint has a thickness and an elongated width relative to the thickness.

21. The closing method of claim 17 wherein:

the securing step includes attaching a fastening flap having a securing panel to the front sheet below the splint, and demountably securing the securing panel to a cooperating panel on the back sheet.

22. The closing method of claim 21 wherein:

said securing panel of said fastening flap and said cooperating panel of said back sheet comprise a hook-and-loop-type fastener.

23. A method for leak-proof closing of a container, which comprises:

a. joining together sides of a front sheet of flexible material and of a back sheet of flexible material of an upper portion of a flexible container, leaving a top edge of each sheet apposite but not sealed to the other top edge, b. attaching to the back sheet below the top edge thereof and extending approximately from one side of the back sheet to the other side a semi-rigid splint having in cross-section a thickness and an elongated width relative to the thickness, the splint further having a linear rest position and a physical memory which urges it to return to said linear rest position after being flexed, such that a passage large enough to admit a hand therethrough into the container is provided by flexing the splint and separating the sheets, an upper edge of the splint spaced at least twice the width of the splint from the top edge of the back sheet, c. folding an upper section of the sheets, bounded by the top edge of the sheets on top and by the upper edge of the splint on bottom, over the splint at a first fold line coincident with the upper edge of the splint thereby forming a first fold and bringing the upper section of the sheets into apposition with the splint, d. folding the upper section of the sheets and a lower section of the sheets forward at a second fold line coincident with a lower edge of the splint, the lower section of the sheets bounded on top by the upper edge of the splint, thereby forming a reverse fold of the upper section of the sheets adjacent the lower edge of the splint and converse to the first fold and trapping the reverse fold between the splint and the lower section of the sheets, and e. attaching a fastening flap having a securing panel to the front sheet below the splint, and demountably securing the securing panel to a cooperating panel on the back sheet.

24. The method of claim 23 wherein:

the front and back sheets of flexible material comprise polyurethane.

25. The method of claim 24 wherein:

the securing panel of the fastening flap and the cooperating panel of the back sheet comprise a hook-and-loop-type fastener.

26. The closure of claim 4 wherein:

said container has a tube having a valve.

* * * * *